US005544605A

United States Patent [19]

Frost

[11] Patent Number: 5,544,605

[45] Date of Patent: Aug. 13, 1996

[54] AUXILIARY YARN FEED MODULE FOR TUFTING MACHINE WITH PATTERN CONTROL YARN FEED MECHANISM

[75] Inventor: Steven L. Frost, Signal Mountain, Tenn.

[73] Assignee: Tuftco Corporation, Chattanooga, Tenn.

[21] Appl. No.: 209,517

[22] Filed: Mar. 10, 1994

[51] Int. Cl.[6] ..... D05C 15/26

[52] U.S. Cl. ..... 112/475.23; 112/80.73

[58] Field of Search ..... 112/80.23, 80.73, 112/121.11, 80.01, 80.7, 266.2, 475.23

[56] References Cited

U.S. PATENT DOCUMENTS

| | | | |
|---|---|---|---|
| 2,862,465 | 12/1958 | Card . | |
| 2,935,037 | 5/1960 | Card . | |
| 2,966,866 | 1/1961 | Card . | |
| 3,847,098 | 11/1974 | Hammel . | |
| 4,193,358 | 3/1980 | Woodcock . | |
| 4,237,802 | 12/1980 | Scott | 112/80.73 |
| 4,267,787 | 5/1981 | Fukuda | 112/80.23 |
| 4,411,207 | 10/1983 | Brock et al. | 112/80.73 |
| 4,608,935 | 9/1986 | Bardsley . | |
| 4,688,497 | 8/1987 | Card et al. | 112/80.73 |
| 4,864,946 | 9/1989 | Watkins | 112/80.73 |
| 5,005,498 | 4/1991 | Taylor et al. | 112/80.73 |
| 5,058,518 | 10/1991 | Card et al. | 112/80.23 |
| 5,383,415 | 1/1995 | Padgett, III | 112/80.73 |

*Primary Examiner*—Paul C. Lewis
*Attorney, Agent, or Firm*—Douglas T. Johnson

[57] ABSTRACT

An auxiliary yarn feed mechanism for a tufting machine having a plurality of needles for tufting yarns through a moving base fabric. A tufting machine with a pattern control yarn feed mechanism is provided with an auxiliary yarn feed to permit the tufting machine to be threaded with yarn and operated to produce rugs in a variety of sizes with side and end borders.

1 Claim, 6 Drawing Sheets

AUXILIARY YARN FEED MODULE FOR TUFTING MACHINE WITH PATTERN CONTROL YARN FEED MECHANISM

BACKGROUND OF THE INVENTION

This invention relates to a tufting machine equipped with a pattern control yarn feed mechanism. The invention provides an auxiliary yarn feed to enable the pattern control yarn feed mechanism equipped tufting machine to produce patterned rugs in a variety of sizes with side and end borders.

In U.S. Pat. No. 2,862,465 a yarn feed mechanism is described in which a plurality of yarn feed rolls are individually clutch controlled by a pattern control mechanism so that each of the plurality of feed rolls is driven at different speeds independently of the other feed rolls. Similar and improved pattern control yarn feed mechanisms are described in U.S. Pat. Nos. 3,847,098 and 4,608,935. These mechanisms are generally referred to as "Scroll Pattern Attachments."

A tufting machine equipped with a scroll pattern attachment is adapted to make patterns of high and low loop pile on the backing fabric moving through the tufting machine. When fitted with the proper cutting attachment, the high loop pile tufts can be cut so that the tufting machine creates patterns of high cut pile and low loop pile. These patterns can be complicated, curved shapes, made with control of individual yarns in the patterns, but with available equipment the patterns must be made in repeats duplicated at intervals across the width of the tufting machine. The repeat width is determined by the number of pattern rolls, the needle gauge of the tufting machine and the design of the tube bank which guides the yarn from its respective pattern roll to individual needles. Scroll pattern attachments are designed for use on broadloom tufting machines and generally the "scroll" type patterns are intended for wall-to-wall carpeting.

The carpet industry has long desired to be able to utilize tufting machines equipped with scroll pattern attachments to make scatter rugs as well as broadloom carpet. Scatter rugs are made in a number of standard sizes, such as 2'×3', 3'×5', and 9'×12'. Scatter rugs can be made in any desired size, but it is desirable that each rug have a border completely around it, and is usually bound or serged around all the edges, so that the rug has a finished appearance.

Tufting machines, generally of smaller size than broadloom tufting machines, are made specifically for scatter rugs with roll-type pattern attachments such as that described in U.S. Pat. No. 2,966,866 or universal type pattern attachments such as that described in U.S. Pat. No. 2,935,037. These pattern attachments are simpler than scroll pattern attachments in that they do not require the use of a tube bank and are limited to simpler patterns.

The primary difficulty encountered in adapting tufting machines with scroll pattern attachments to make scatter rugs has been the necessity of providing uniform side borders and end borders and a cut line between rugs. While it is possible to create the necessary end borders by energizing all of the clutches simultaneously to produce a high or low end border and a distinct cut line, there has not heretofore been a practical way to make uniform side borders and to locate them at any width to accommodate various rug sizes. Indeed, it was heretofore believed that a special tube bank would be required to adapt a scroll pattern attachment to produce scatter rugs of each distinct size.

SUMMARY OF THE INVENTION

It is therefore an object of this invention to provide an auxiliary yarn feed mechanism for a tufting machine already incorporating a scroll type pattern control yarn feed mechanism which will allow the production of scatter rugs of varying widths with uniform side borders.

The auxiliary yarn feed mechanism made in accordance with this mechanism includes a horizontal roll or rolls intermediate the yarn supply and the tube bank of the scroll type pattern control yarn feed mechanism. The horizontal roll or rolls extend substantially across the entire width of the tufting machine, or at least across a substantial portion of the width of the tufting machine, and are operated at a constant high or low speed to produce a corresponding high or low border. The yarns for the needles in the desired location of the side borders are unthreaded from their normal pattern controlled feed rolls and are instead threaded around the auxiliary roll or rolls and fed through their respective tube bank tubes.

DETAILED DESCRIPTION OF THE DRAWINGS

Figure 1:
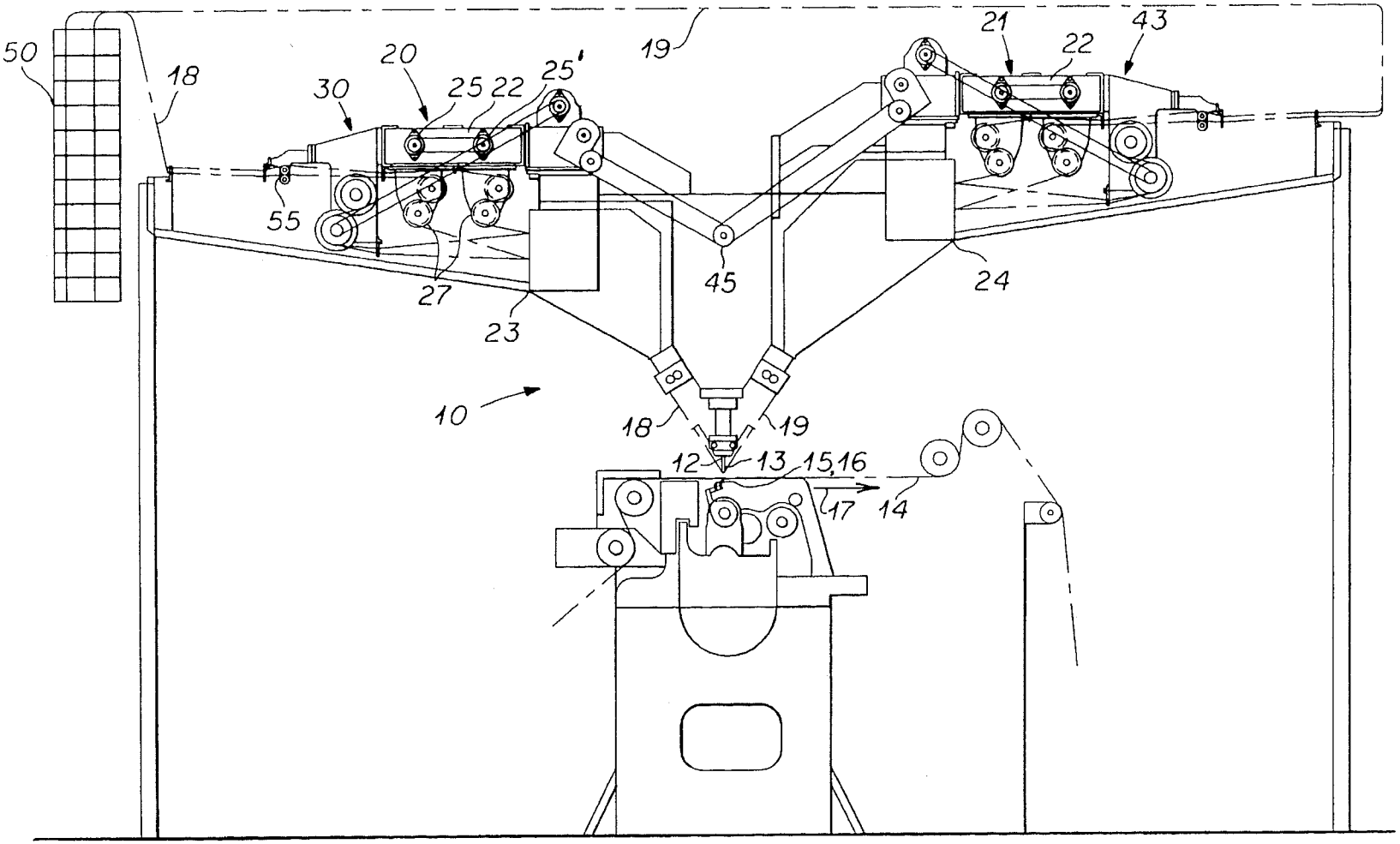
FIG. 1 is a cross-sectional side view of a tufting machine with front and back scroll pattern attachment yarn feed mechanisms and auxiliary yarn feed mechanisms according to the present invention attached to each scroll pattern attachment mechanism.

Referring first to FIG. 1, a typical tufting machine 10 is disclosed with front and rear needle bars holding rows of front needles 12 and rear needles 13 disposed transversely of the tufting machine 10 for vertical reciprocal movement through a base fabric 14 moving longitudinally through the tufting machine from front to rear in the direction of the arrow 17. Each front needle 12 cooperates with a front looper or hook 15 and each rear needle 13 cooperates with a rear looper or hook 16 to form tufted stitches through the base fabric 14. The needles 12, 13 and loopers 15, 16 are synchronously reciprocated in a well known manner from the drive mechanism, not shown, which also rotates a drive wheel 45.

The tufting machine 10 is also illustrated with a front scroll pattern attachment 20 including a front tube bank 23 and a rear scroll pattern attachment 21 including a rear tube bank 24. The front auxiliary yarn feed module 30 of the present invention is shown mounted on the front scroll attachment 20. The rear auxiliary yarn feed module 43 is shown mounted on the rear scroll attachment 21. It should be made clear that the auxiliary yarn feed module according to the present invention may also be mounted on a tufting machine with only one scroll pattern attachment or on a tufting machine with only one row of transversely disposed needles.

Figure 2:
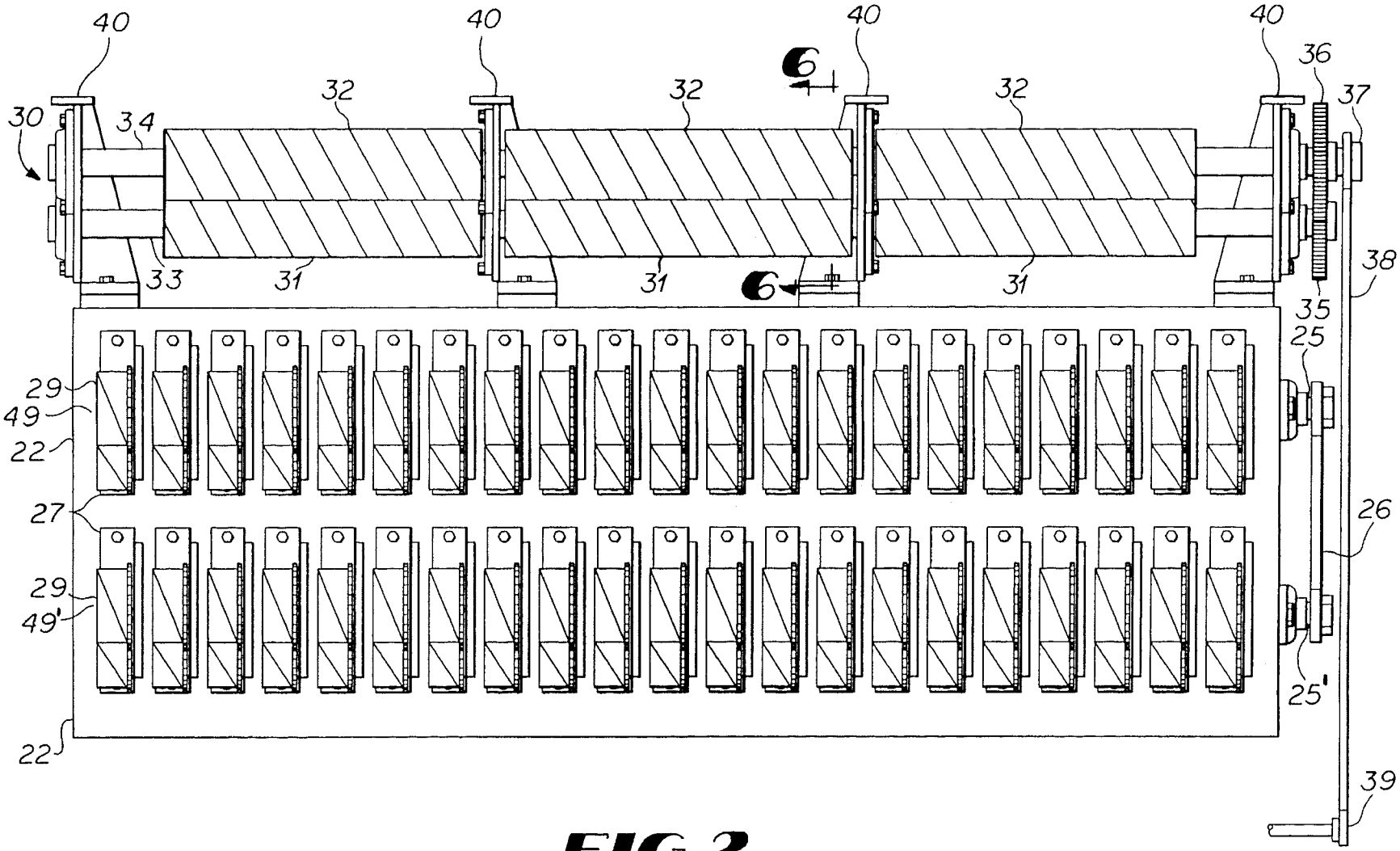
FIG. 2 is a bottom view of a scroll pattern attachment yarn feed mechanism with an auxiliary yarn feed mechanism according to the present invention.

Each scroll pattern attachment 20, 21 may contain two or more drive shafts, rotatably supported in the housing 22. The illustrated scroll pattern attachments 20, 21 have two sets of two drive shafts, of which only one shaft 25 of the outwardly located set and one shaft 25' of the inwardly located set is visible. The shafts, 25, 25' rotate at the same speed and are synchronized by chain 26. One other shaft, not pictured, is paired with each of the pictured drive shafts 25, 25' and is driven at a relatively higher speed from drive shaft 25, 25'. Each drive shaft has fixed upon it a drive gear of equal size, not pictured. A clutch module 27 is mounted to a slot in the housing corresponding to the location of the drive gears. In the typical scroll pattern attachment there will be approximately 120 clutch modules 27, although substantially fewer are shown in FIG. 2 for illustrative purposes.

Figure 3:
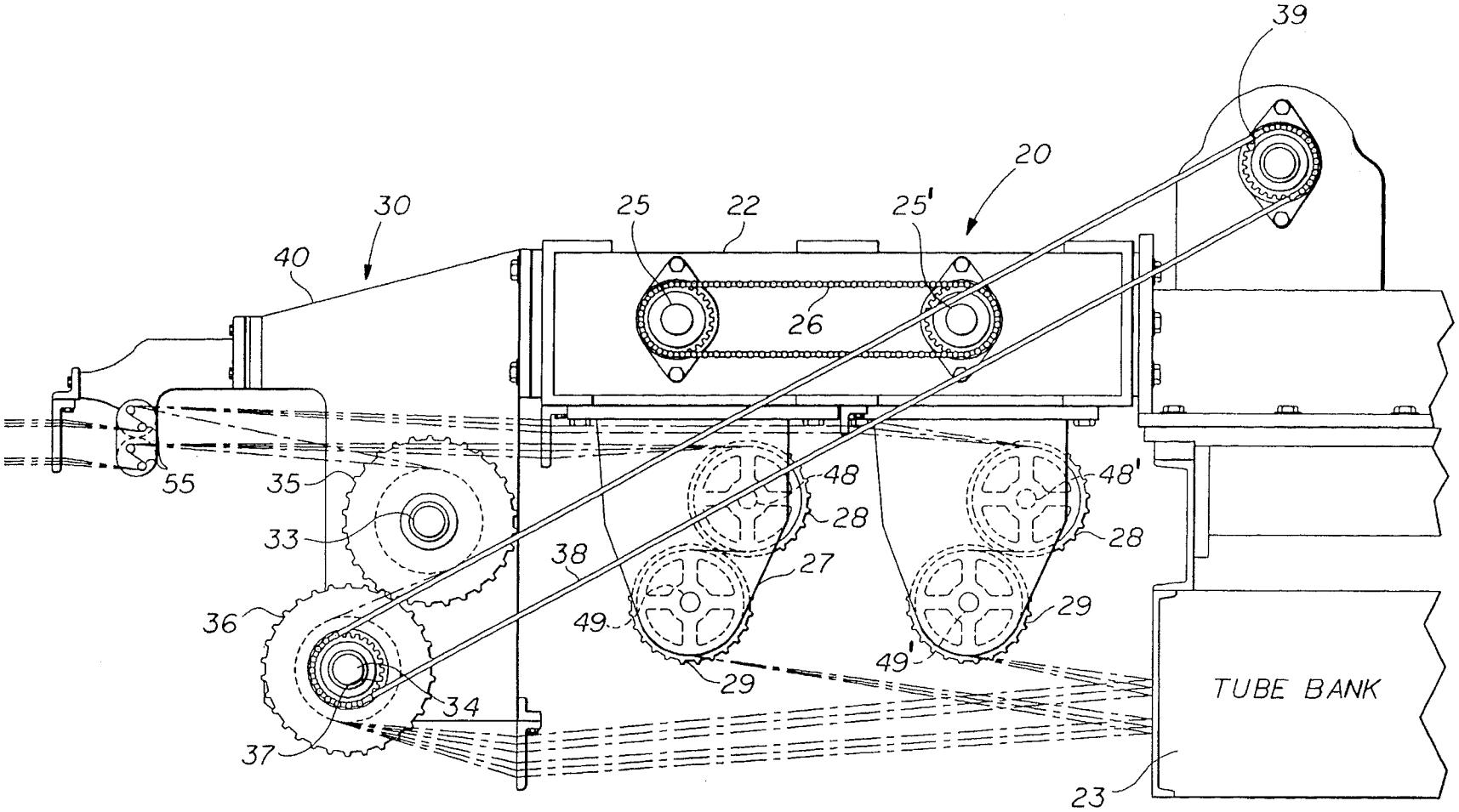
FIG. 3 is a side view of a scroll pattern attachment yarn feed mechanism with an auxiliary yarn feed mechanism according to the present invention.

As shown in FIG. 3, and described in greater detail in U.S. Pat. No. 3,847,098, mounted in each clutch module 27 is a pair of yarn feed rolls, including a lower feed roll 29 and an upper feed roll 28. Mounted concentrically within each feed roll 28 and 29 respectively, and not shown, is a high speed rotary electromagnetic clutch member and a low speed rotary electromagnetic clutch member. Yarn feed rolls 28 and 29 also carry fixed intermediary ring gears which intermesh with each other so that both yarn feed rolls 28, 29 are always driven at the same speed.

Lower yarn feed roll 29 is mounted upon a shaft 49 which is driven at relatively low speed by a chain, not pictured, connecting the drive gear on drive shaft 25 to a corresponding drive gear on shaft 49. When the magnetic clutch in lower yarn feed roll 29 is energized, it is adapted to couple lower yarn feed roll 29 to its driven shaft 49 and accordingly, both upper and lower yarn feed rolls 28, 29 are driven at lower speed.

Upper yarn feed roll 28 is mounted upon a shaft 48 which is driven at relatively high speed by a chain, not shown, connecting the drive gear on the high speed shaft to a corresponding gear on shaft 48. When the magnetic clutch in upper yarn feed roll 28 is energized, it is adapted to couple upper yarn feed roll 28 to its driven shaft 48 and accordingly, both upper and lower yarn feed rolls 28, 29 are driven at high speed.

Yarn passing from creels or other yarn storage devices 50 over tension bar 55 and around upper and lower yarn feed rolls 28, 29 is thereby supplied in relatively longer increments if the yarn feed rolls 28, 29 are driven at high speed, or relatively shorter increments if the yarn feed rolls 28, 29 are driven at low speed. Yarn so supplied passes down through the front tube bank 23. The yarn tubes then distribute the respective front yarns 18 to corresponding front needles 12 in the same manner disclosed in U.S. Pat. No. 2,862,465. When relatively longer increments of front yarn 18 are supplied to the front needles 12, relatively high pile tufts are created by the front needles 12 penetrating the base fabric 14. When relatively shorter increments of front yarn 18 are supplied to the front needles 12, relatively short pile tufts are created by the front needles 12 penetrating the base fabric 14. The rear yarn 19 is supplied to the rear needles 13 in a similar fashion and intricate patterns can thereby be created in the resulting carpet.

In order to adapt the tufting machine 10 illustrated in FIG. 1 with scroll pattern attachments 20, 21 to manufacture scatter rugs, the illustrated auxiliary yarn feed modules 30, 43 are mounted on the tufting machine 10, preferably between the yarn supply 50 and each scroll pattern attachment 20, 21. The auxiliary yarn feed module 30 is shown in greater detail in FIGS. 2 and 3. As shown in FIG. 2, the auxiliary yarn feed module 30 consists of an upper border feed roll, or upper auxiliary yarn feed roll 31 and a lower border feed roll 32 each of which preferably extend across a substantial width of the tufting machine. The upper and lower border feed rolls 31 and 32 are mounted on upper and lower drive shafts 33 and 34 respectively. Illustrated drive shafts 33 and 34 are also fitted with intermeshing gears 35 and 36 so that both drive shafts are always driven at the same speed. Drive shafts 33 and 34 are supported by a plurality of auxiliary yarn feed supports 40 which are mounted on the housing 22 of the pattern control yarn feed attachment 20.

Figure 5:
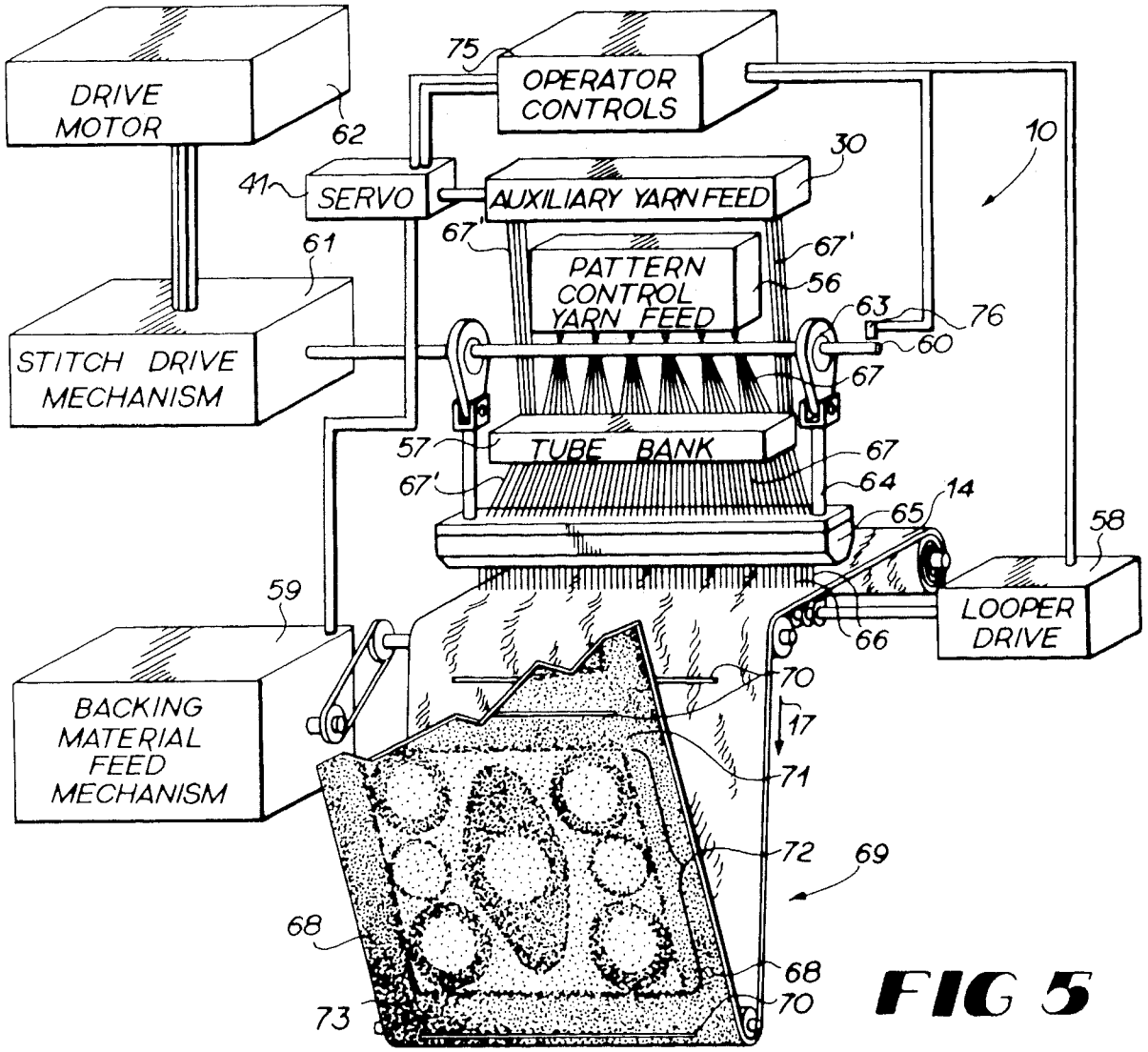
FIG. 5 is a schematic of the present invention showing the production of the rug pattern of FIG. 4, but where the auxiliary yarn feed drive is powered by a servo motor controlled by a computer.

In the illustrated embodiment, a drive sprocket 37 is mounted on the lower drive shaft 34 and is connected by a drive chain 38 to a main drive sprocket 39 which can be the drive wheel 45, shown in FIG. 1, or which can be some other linkage to the needle drive mechanism, or can be driven by independent servo motors 41, shown in FIG. 5. The main drive sprocket 39 thus causes the border yarn feed rolls 31 and 32 to rotate at a constant rate generally selected to be either the high or low speed of the scroll pattern attachment 20.

Figure 6:
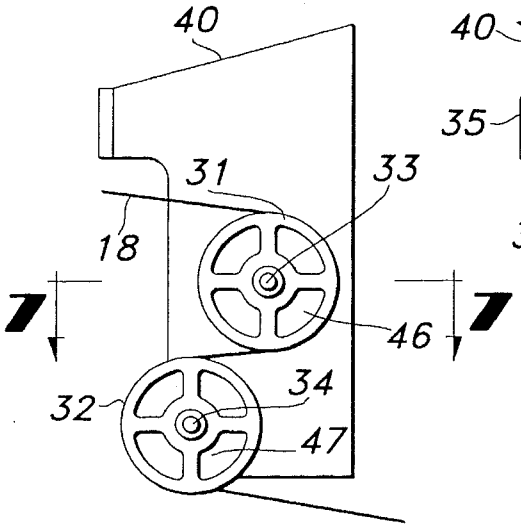
FIG. 6 is a fragmentary section taken along the line 6—6 of FIG. 2.

In a more complex variation, the auxiliary yarn feed module 30 may be equipped with rotary electromagnetic clutches. For example, as shown in FIG. 6 a magnetic clutch 46 may be placed on the upper drive shaft 33 and driven at a relatively high speed and a magnetic clutch may be placed on the lower drive shaft 34 and driven at a relatively low speed. By selectively engaging the magnetic clutch on either the upper drive shaft 33 or lower drive shaft 34, the upper and lower border feed rolls 31 and 32 can be driven at selectively high or low speed. In a more complex variation, magnetic clutches may be placed within the upper and lower border feed rolls 31 and 32 and the upper drive shaft 33 may be driven at a relatively high speed while the lower drive shaft 34 is driven at a relatively low speed. By selectively engaging the magnetic clutches in either the upper border feed roll 31 or the lower border feed roll 32, the border feed rolls 31 and 32 can be driven at selectively high or low speed in the same fashion as the individual feed rolls in the scroll pattern attachment. When electromagnetic clutches are used within the border feed rolls 31 and 32, the intermeshing gears 35, 36 are placed directly on the border feed rolls 31, 32 rather than on the drive shafts 33, 34 as intermeshing gear 35 is depicted in FIG. 7.

Figure 7:
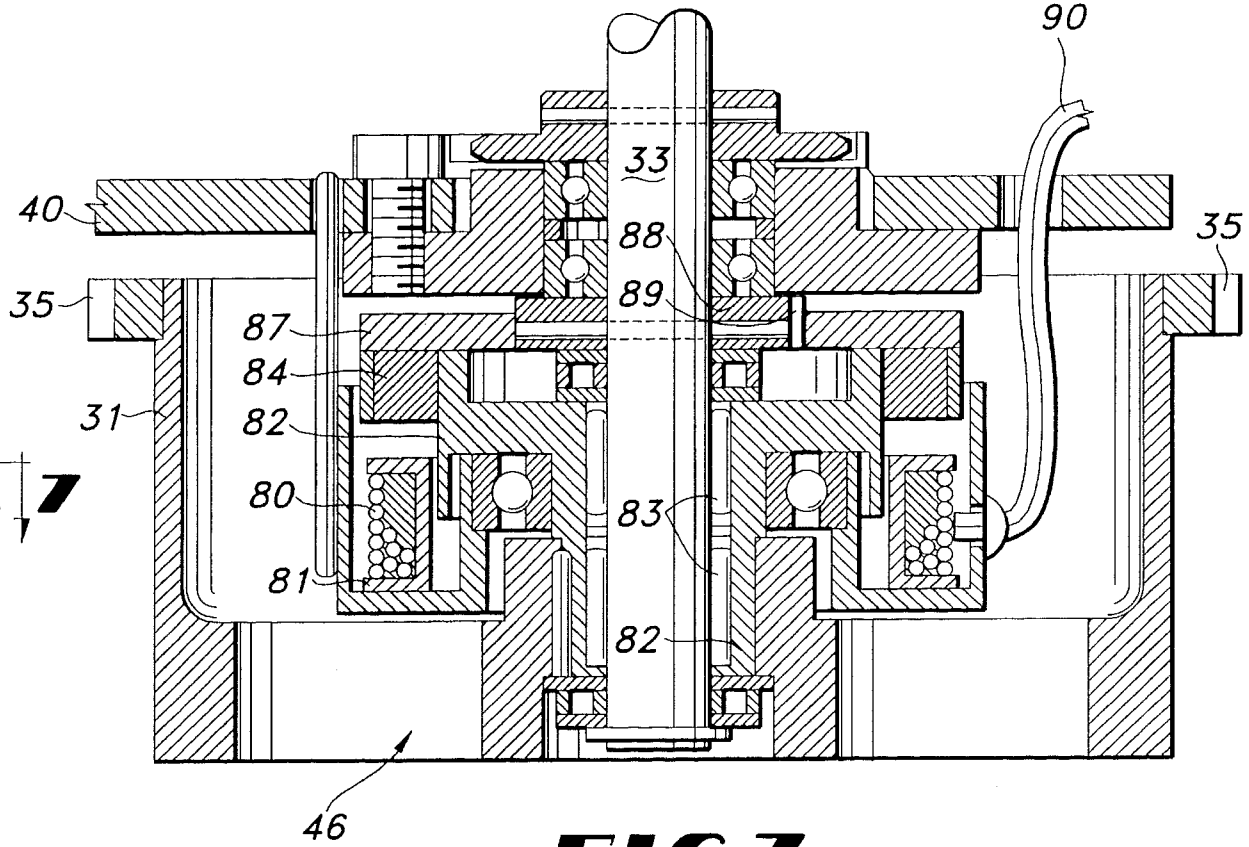
FIG 7 (PRIOR ART)
FIG. 7 is an illustration of a prior art electromagnetic clutch shown in position along the line 7—7 of FIG. 6.

A specific prior art magnetic clutch 46 or 47, which can be incorporated in the auxiliary yarn feed mechanism 30, is disclosed in FIG. 7. The electromagnetic clutch 46 includes a disc-shaped clutch armature 87, splined at 88 to hub 89, which is fixed to the drive shaft 33 by a pin or other securing means, so that the armature 87 may move axially of the shaft 33 and yet rotate with the shaft 33. The electromagnetic coil 80 is held in fixed position in a bracelet 81 fixed to the strut 40. The clutch rotor 82 is fixed to the feed roll 31 and journaled in bearings 83 for relative independent rotation about the shaft 33. The clutch rotor 82 may be provided with an annular frictional surface 84 for engagement with the armature 87. In the illustration of FIG. 7, the armature 87 is engaging the clutch rotor 84 while the coil 80 is energized. When the coil 80 is de-energized, the armature 87 disengages the rotor 82 to permit the feed roll 31 to rotate independently of the driven shaft 33. Electrical current is supplied to coil 80 through leads 90 which are in turn connected to the computer of the operator controls.

In order to produce scatter rugs on the tufting machine 10 in FIG. 1, the front needles 12 and rear needles 13 which are to produce the design or patterned portion of the scatter rugs are threaded as usual. Front yarns 18 come from the yarn supply 50 through the tension bar 55 around upper and lower yarn feed rolls 29, 28 and through the front tube bank 23 to front needles 12. Rear yarns 19 are similarly threaded through the rear scroll pattern attachment 21 and rear tube bank 24 to rear needles 13. In the most common patterns all of the front yarns will be of a first color and all of the rear yarns will be of a second color.

The front needles 12 on either side of the design or patterned portion of the scatter rugs are used to create the side borders. The front yarn 18 for these front needles 12 is supplied from the yarn supply 50 through the tension bar 55, around the upper and lower border feed rolls 31 and 32 and thence through the front tube bank 23 to the front needles 12 on either side of the patterned portion. In operation, the border feed rolls 31 and 32 rotate at a constant speed so that the pile height of the side borders remains uniform.

As an example, when the border feed rolls 31 and 32 supplying the front yarns are driven at relatively high speed, the front border of the scatter rug is created by also running the upper and lower yarn feed rolls 29 and 28 of those clutch modules 27 threaded with the same color or type of yarn as the front yarns used to create the side borders (usually all of the clutch modules of the front scroll pattern attachment), at relatively high speed. Thus, there will be a uniform front border for a predetermined number of stitches. At the same time the border feed rolls supplying the rear yarns are run at relatively low speed as are the upper and lower yarn feed rolls of those clutch modules threaded with yarns of different color or type from those used to create the border (usually all of the clutch modules of the rear scroll pattern attachment).

When the pattern is begun, the upper and lower yarn feed rolls 29 and 28 of the clutch modules 27 are driven at selectively higher or lower speeds to produce the desired pattern. However, the yarns forming the side borders do not pass through clutch modules 27 and are instead driven by the upper and lower border feed rolls 31 and 32 so that the side border of the scatter rug remains uniform with the front border. Thus the front yarns forming the side borders are always driven at relatively high speed by the front auxiliary yarn feed module 30 and rear yarns are driven at relatively low speeds by the rear auxiliary yarn feed module 43. In this fashion, the rear yarns are buried and the carpet has the same weight and appearance in the side borders as in the front and rear borders.

After the tufting machine 10 has executed the predetermined number of stitches in the pattern, a rear border is created by again running the upper and lower yarn feed rolls 29 and 28 of the selected yarn feed modules 27 threaded with the same color or type of yarn as the front needles 12 forming the side borders, at relatively high speed. Yarn feed modules threaded with other yarns are run at relatively low speeds. After the predetermined number of stitches to complete the rear border, all upper and lower yarn feed rolls 29 and 28 of all clutch modules 27 are run at low speed for at least one stitch to form a cut line marking the end of that particular rug.

Figure 4:
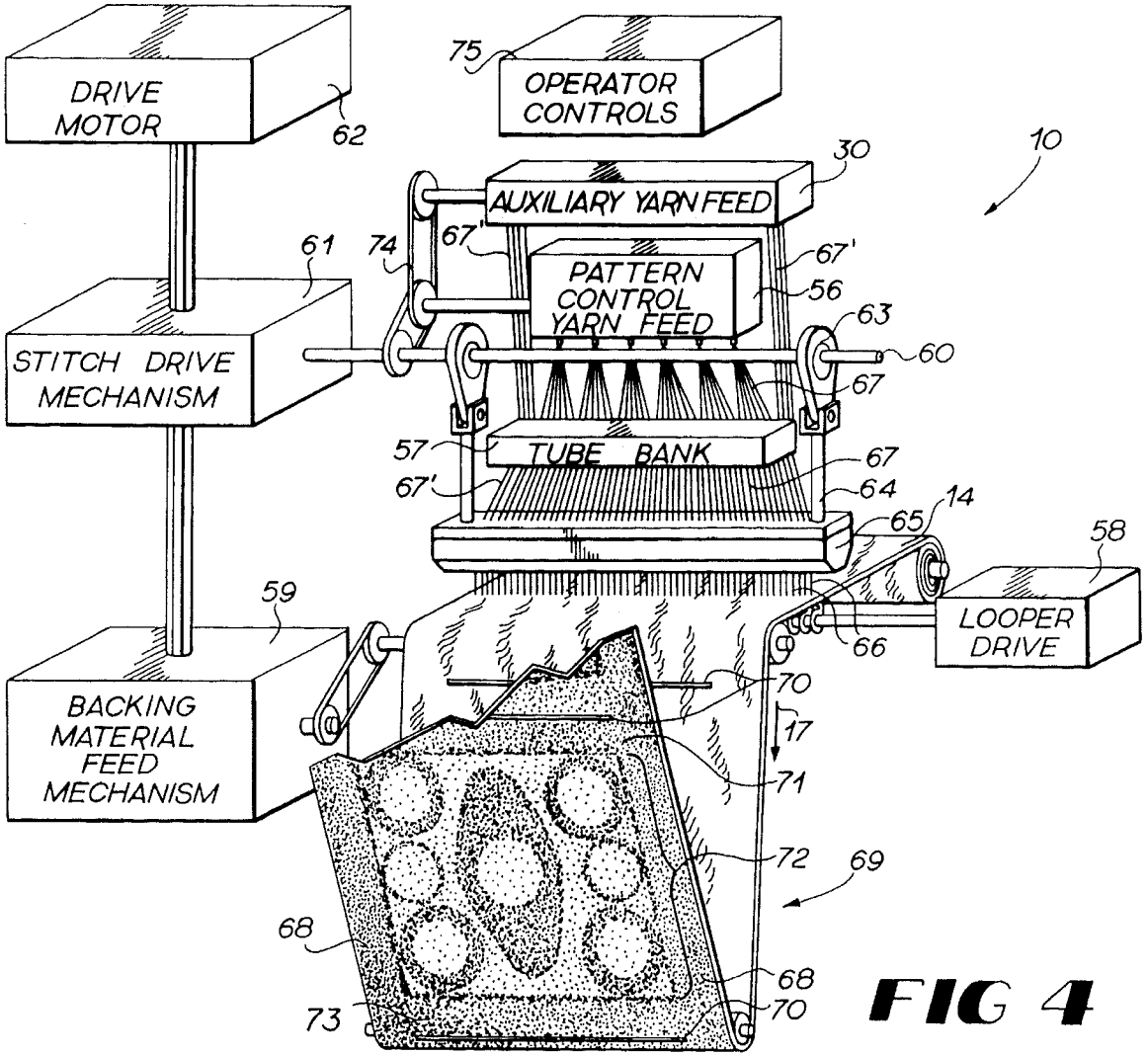
FIG. 4 is a schematic representation of the present invention showing the production of a rug pattern with a cut line between rugs on a tufting machine with a single needle bar.

The schematic diagram in FIG. 4 discloses a single needle bar tufting machine 10 practicing the present invention. This tufting machine 10 includes a main drive shaft 60 driven by a stitch drive mechanism 61 from a drive motor 62. Eccentrics 63 mounted upon the main drive shaft 60 are adapted to reciprocally move push rods 64 for vertically and reciprocally moving the needle bar 65. The needle bar 65 supports a plurality of uniformly spaced tufting needles 66 in a longitudinal row, or staggered longitudinal rows, extending transversely of the feeding direction 17 of the base fabric 14.

The base fabric 14 is moved through the tufting machine 10 by the backing material feed mechanism 59. Yarns 67 and 67' are fed from the tube bank to the respective needles 66. As each needle 66 carries a yarn 67, 67' through the base fabric 14, a hook or looper is reciprocally driven by the looper drive 58 to cross each corresponding needle 66 and hold the corresponding yarn 67, 67' to form loops. Yarn 67, 67' is provided from a creel or other yarn supply, not shown, to either the auxiliary yarn feed module 30 or the scroll pattern attachment 56. From the auxiliary yarn feed module 30, yarns 67' are supplied to the tube bank 57 where those yarns 67' are directed to the needles 66 forming the side borders 68 of the carpet. From the scroll pattern attachment or pattern control yarn feed 56, yarns 67 are supplied to the needles 66 which form the pattern portion of the carpet. An electrical or mechanical stitch counting mechanism is used to count the stitches for the front border 71, pattern portion 72, rear border 73 and cut line 70 between rugs. Typically the stitch counting mechanism comprises a computer, and a computer program or subroutine as a part of the operator controls 75 utilized in connection with a sensor 76, shown in FIG. 5, which detects the revolutions of the main drive shaft 60 or the reciprocations of the push rods 64 and needle bar 65.

It will be appreciated that the auxiliary yarn feed 30 and the pattern control yarn feed 56 may either be driven by linkage 74 to the stitch drive 61, or by servo motors 41, shown in FIG. 5, controlled electrically from the operator controls 75. The resulting carpet is then cut along the cut lines 70 and the separate rugs are bound or serged around the edges to provide a finished appearance.

FIG. 5, depicts the modern computer controlled tufting machine in which the computer and computer program of the operator controls 75 utilize sensor 76 to detect revolutions or the position of the main drive shaft 60. Based upon this information, signals are sent to servo motors powering the looper drive 58, backing material feed mechanism 59, pattern control yarn feed 56 and auxiliary yarn feed 30 to supply the yarns and backing fabric at the rates required by the pattern being tufted.

Numerous alterations of the structures and methods herein described will suggest themselves to those skilled in the art. It will be understood that the details and arrangements of the parts and yarns that have been described and illustrated in order to explain the nature of the invention are not to be construed as any limitation of the invention. All such alterations which do not depart from the spirit of the invention are intended to be included within the scope of the appended claims.

What is claimed is:

1. A method of manufacturing patterned and bordered scatter rugs on a tufting machine having a plurality of reciprocal needles operated by a needle drive to stitch at least first and second yarns provided from a yarn supply through base fabric, and also having a pattern control yarn feed mechanism utilizing a tube bank to direct individual yarns to respective needles, and further having an auxiliary yarn feed mechanism, comprising the steps of:

(a) threading the first and second yarns which are to form the pattern portion of the scatter rugs from the yarn supply through the pattern control yarn feed mechanism and tube bank to respective needles;

(b) threading the first yarns which are to form the side border portions of the scatter rugs from the yarn supply through the auxiliary yarn feed mechanism and the tube bank to respective needles;

(c) initializing a stitch counting mechanism;

(d) feeding the base fabric through the tufting machine for a predetermined number of stitches comprising the front border of a scatter rug, with the auxiliary yarn feed mechanism supplying first yarns from the yarn supply to respective needles at a constant high speed, and the pattern control yarn feed mechanism supplying first yarns at a high speed and supplying second yarns at a low speed to respective needles;

(e) feeding the base fabric through the tufting machine for a predetermined number of stitches comprising the patterned section of a scatter rug with the auxiliary yarn feed mechanism supplying first yarns from the yarn supply to respective needles at a constant high speed, and the pattern control yarn feed mechanism supplying first yarns at high and low speed and supplying second yarns at high and low speed to respective needles as indicated by the pattern;

(f) feeding the base fabric through the tufting machine for a predetermined number of stitches comprising the rear border of a scatter rug, with the auxiliary yarn feed mechanism supplying first yarns from the yarn supply to respective needles at a constant high speed, and the pattern control yarn feed mechanism supplying first yarns at a high speed and supplying second yarns at a low speed to respective needles;

(g) feeding the base fabric through the tufting machine for at least one stitch with the pattern control yarn feed mechanism supplying all first and second yarns to respective needles at low speed to form a cut line;

(h) repeating steps (d) through (g) until a plurality of patterns have been tufted;

(i) cutting the patterned base fabric into separate scatter rugs along the cut lines;

(j) binding or serging the edges of each scatter rug to provide a finished appearance.

* * * * *